US008363078B2

(12) United States Patent
Kitamura

(10) Patent No.: US 8,363,078 B2
(45) Date of Patent: Jan. 29, 2013

(54) PRINTING APPARATUS AND METHOD OF CONTROLLING THE SAME

(75) Inventor: Gen Kitamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 332 days.

(21) Appl. No.: 12/922,549

(22) PCT Filed: Mar. 16, 2009

(86) PCT No.: PCT/JP2009/055560

§ 371 (c)(1),
(2), (4) Date: Sep. 14, 2010

(87) PCT Pub. No.: WO2009/116654

PCT Pub. Date: Sep. 24, 2009

(65) Prior Publication Data

US 2011/0012979 A1 Jan. 20, 2011

(30) Foreign Application Priority Data

Mar. 17, 2008 (JP) ..... 2008-067879

(51) Int. Cl.
*B41J 11/42* (2006.01)
*B41J 11/70* (2006.01)

(52) U.S. Cl. ..... 347/218

(58) Field of Classification Search ..... 347/172, 347/174, 176, 215, 218, 104; 400/120.02, 400/120.04

See application file for complete search history.

(56) References Cited

U.S. PATENT DOCUMENTS 7,352,380 B2 * 4/2008 Takano et al. ..... 347/194

FOREIGN PATENT DOCUMENTS

| | | | |
|---|---|---|---|
| CN | 1600554 | | 3/2005 |
| CN | 1833871 | | 9/2006 |
| JP | 60-165270 | * | 8/1985 |
| JP | 7-246740 | | 9/1995 |
| JP | 2003-54054 | | 2/2003 |

OTHER PUBLICATIONS

Chinese Office Action for Application No. 200980109637.1 dated Apr. 16, 2012.

* cited by examiner

*Primary Examiner* — Huan Tran
(74) *Attorney, Agent, or Firm* — Carter, DeLuca, Farrell & Schmidt LLP

(57) ABSTRACT

A printing apparatus which is capable of performing excellent printing without leaving a conveying roller mark on roll paper for printing of a next image even when the operation of the apparatus is stopped for cooling. A thermal head performs printing by sequentially transferring a plurality of color inks coated on an ink ribbon onto the roll paper drawn out from a cartridge, in superimposed relation. The roll paper is conveyed in a state nipped by a conveying roller pair. A thermistor detects a temperature within the apparatus. After completion of printing in one color, the roll paper is conveyed to a print start position at a first conveying speed, for execution of printing in another color. When the detected temperature is higher than a predetermined value, the roll paper is conveyed to the print start position at a second conveying speed which is slower than the first conveying speed.

12 Claims, 6 Drawing Sheets

PRINTING APPARATUS AND METHOD OF CONTROLLING THE SAME

BACKGROUND OF THE INVENTION

1. Field of the Invention

The present invention relates to a printing apparatus for printing images and a method of controlling the printing apparatus.

2. Description of the Related Arts

In recent years, printing apparatuses configured to capture image data picked up by an image pickup apparatus, such as a digital camera, and print the image data on a recording medium, such as a print sheet, have come into widespread use in general households.

Conventionally, such printing apparatuses for home use generally use cut sheets for printing. However, print sheets to be contained in a cartridge are not necessarily limited to cut sheets, but roll paper formed by winding belt-like print paper around a roller may be used.

The use of roll paper for printing is advantageous e.g. in that it is possible not only to hold a large amount of print paper in a space-saving cartridge, but also to share a conveying mechanism including a cartridge for different print sizes.

In a case where a cut sheet is used for printing, the cut sheet is required to have a larger size than a print area so as to be held during a printing operation. For this reason, a user sometimes has to cut off a portion of the cut sheet surrounding the print area, which serves to hold the print area, for him/herself after completion of the printing.

On the other hand, in a case where roll paper is used for printing, a cutter for cutting print paper is provided in a printing apparatus, and therefore the printing apparatus is capable of cutting off only a print area to provide the same to the user.

FIG. 10 is a view of a conventional printing apparatus using roll paper in a state immediately before the start of a printing operation. FIG. 11 is a view of the printing apparatus in a state immediately after the end of the printing operation. FIG. 12 is a view of the printing apparatus in a state immediately after the end of a discharge operation.

The sequential printing operations carried out by the conventional printing apparatus will be described with reference to FIGS. 10 to 12.

Roll paper 1 loaded in the printing apparatus is fed by a feed roller, not shown, with its leading end directed forward, to be nipped by a conveying roller pair 4. Thereafter, the roll paper 1 is reciprocated to and fro by the conveying roller pair 4, whereby the sequential operations from printing to discharge are carried out without ever releasing the roll paper 1 from the nipped state.

In the case of printing an image with a length X in a roll paper conveying direction, the roll paper 1 is conveyed by the conveying roller pair 4 until a printing start point S on the roll paper 1, which is located at a distance X from the roll paper leading edge, is brought to a position (print start position) immediately below a heating element of a thermal head 3 (see FIG. 10).

Then, the roll paper 1 is brought into pressure contact with the thermal head 3 and a platen roller 6 opposed to the thermal head 3 at the printing start point S, together with an ink ribbon 2.

Thereafter, the roll paper 1 is conveyed in a direction in which the roll paper leading end moves toward the thermal head 3 (i.e. in a leftward direction as viewed in FIG. 10).

Simultaneously, the ink ribbon 2 is conveyed by a ribbon drive mechanism, not shown, in the same direction as the roll paper conveying direction.

At this time, the heating element of the thermal head 3 generates heat, whereby ink on the ink ribbon 2 is transferred onto the roll paper 1 for printing.

The roll paper conveyance is continued until the roll paper leading edge is brought to a position (printing end position) immediately below the heating element of the thermal head 3 (see FIG. 11), whereby the image having the length X (see FIG. 10) is formed.

The ink ribbon 2 is coated with inks of a plurality of colors, such as yellow, magenta, and cyan. Image formation (printing) is performed by transferring the color inks onto the roll paper 1 in superimposed relation. For this reason, the roll paper 1 conveyed to the printing end position is returned again to the print start position by the conveying roller pair 4, and then printing in a next color is repeatedly carried out.

When printing in a final color is completed, the roll paper 1 is conveyed until the printing start point S is moved to a position immediately below a cutter unit 5. Thereafter, the roll paper 1 is cut at the point S by the cutter unit 5, and then only a portion (printout 1-A) having the image formed thereon is discharged (see FIG. 12).

In the case of printing a next image immediately after the above operation, the roll paper 1 is conveyed until a point S' located at a distance corresponding to a length X' of the next image which is measured from the point S at which the roll paper 1 is cut is moved to the position immediately below the heating element of the thermal head 3, whereafter the sequential operations described above are carried out again from the start.

When printing is repeatedly carried out in the above-mentioned printing apparatus, heat generated by the heating element of the thermal head 3 is accumulated in the printing apparatus, which causes a progressive rise in the temperature of a component part of the printing apparatus and the ambient temperature within the apparatus. Then, when the temperature of the component part has exceeded a predetermined value, the heat can break the component part or adversely affect the printing process, thereby hindering normal printing operation.

To cope with this problem, a thermistor or the like is provided in the printing apparatus, and when a temperature detected by the thermistor or the like during a printing operation exceeds the predetermined value, the printing operation is temporarily stopped so as to provide heat dissipation time for making the temperature lower than the predetermined value.

In general, a printing operation is stopped in a state where the roll paper 1 is at the print start position (i.e. a state where the printing start point S is positioned immediately below the heating element of the thermal head 3) (see FIG. 10), so that next conveyance for printing can be started immediately after the temperature becomes lower than the predetermined value.

However, when the operation is suspended over a predetermined time period with the roll paper 1 held at the print start position, a portion of the roll paper 1 nipped by the conveying roller pair 4 is recessed.

This recess is created within a print range X' (S to S') of a next print image to be printed, and hence when the next image is printed, ink cannot be properly transferred, which hinders excellent printing.

To avoid this problem, there is proposed a method in which a margin is produced on roll paper between an area for printing a first image and an area for printing a second image, so that the marginal portion can be nipped by the conveying roller pair when it is required to stop a printing operation (see e.g. Japanese Paten Laid-Open Publication No. 2003-54054).

In the technique disclosed in Japanese Paten Laid-Open Publication (Kokai) No. 2003-54054, however, since the marginal portion cannot be used as a print area, it is impossible to make fully efficient use of the roll paper 1 without waste.

Further, a complicated mechanism is required for feeding roll paper including the marginal portion and then conveying the roll paper to a printing position again.

SUMMARY OF THE INVENTION

The present invention provides a printing apparatus which is capable of performing excellent printing without leaving a conveying roller mark on roll paper for printing of a next image even when the operation of the apparatus is stopped for cooling.

In a first aspect of the present invention, there is provided a printing apparatus comprising a thermal head configured to perform printing by sequentially transferring a plurality of color inks held on an ink sheet onto recording paper in superimposed relation, a conveying unit configured to convey the recording paper in a nipped state so as to transfer the color inks onto the recording paper, a detecting unit configured to detect a temperature within the printing apparatus, and a control unit configured to be operable after completion of printing in one color, to cause the conveying unit to convey the recording paper to a print start position at a first conveying speed in an opposite direction to a direction in which the recording paper is conveyed for printing, so as to carry out printing in a next color, wherein when the temperature detected by the detecting unit is higher than a predetermined value, the control unit causes the conveying unit to convey the recording paper to the print start position at a second conveying speed which is slower than the first conveying speed.

In a second aspect of the present invention, there is provided a method of controlling a printing apparatus which performs printing by sequentially transferring a plurality of color inks coated on an ink sheet onto roll paper in superimposed relation by a thermal head while conveying the roll paper in a state nipped by a conveying unit, comprising detecting a temperature within the apparatus, and after completion of printing in one color, causing the conveying unit to convey the roll paper to a print start position at a first conveying speed in an opposite direction to a direction in which the roll paper is conveyed for the printing operation, so as to carry out printing in a next color, wherein when the detected temperature is higher than a predetermined value, the roll paper is conveyed to the print start position at a second conveying speed which is slower than the first conveying speed.

In a third aspect of the present invention, there is provided a printing apparatus comprising a thermal head configured to perform printing by sequentially transferring a plurality of color inks held on an ink sheet onto recording paper in superimposed relation, a conveying unit configured to convey the recording paper in a nipped state so as to transfer the color inks onto the recording paper, a detecting unit configured to detect a temperature within the printing apparatus, and a control unit configured to be operable after completion of printing in one color, to cause the conveying unit to convey the recording paper to a print start position at a first conveying speed in an opposite direction to a direction in which the recording paper is conveyed for printing, so as to carry out printing in a next color, wherein when the temperature detected by the detecting unit is higher than a predetermined value, the control unit does not stop causing the conveying unit to convey the recording paper even after the recording paper is conveyed to the print start position.

In a fourth aspect of the present invention, there is provided a method of controlling a printing apparatus which performs printing by sequentially transferring a plurality of color inks coated on an ink sheet onto roll paper in superimposed relation by a thermal head while conveying the roll paper in a state nipped by a conveying unit, comprising detecting a temperature within the apparatus, and after completion of printing in one color, causing the conveying unit to convey the roll paper to a print start position at a first conveying speed in an opposite direction to a direction in which the roll paper is conveyed for the printing operation, so as to carry out printing in a next color, wherein when the temperature detected by the detecting unit is higher than a predetermined value, the control unit does not stop causing the conveying unit to convey the recording paper even after the recording paper is conveyed to the print start position.

According to the printing apparatus of the present invention, it is possible to perform excellent printing without leaving a conveying roller mark on roll paper for printing of a next image even when the operation of the apparatus is stopped for cooling.

Further features and aspects of the present invention will become apparent from the following detailed description of exemplary embodiments with reference to the attached drawings.

DESCRIPTION OF THE EMBODIMENTS

The following description of various exemplary embodiments, features and aspects of the present invention is merely illustrative in nature and is in no way intended to limit the invention, its application, or uses.

The present invention will now be described in detail below with reference to the drawings showing an embodiment thereof.

Figure 1:
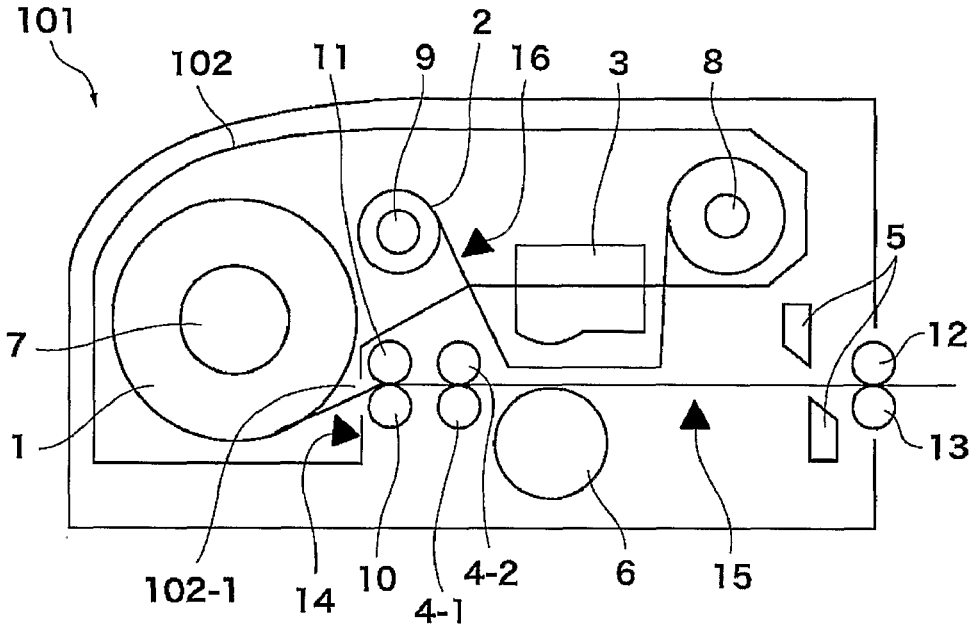
FIG. 1 is a view showing a printing apparatus according to an embodiment of the present invention in a state in which a cartridge is loaded in the apparatus.

FIG. 1 is a view showing a printing apparatus according to the embodiment of the present invention in a state in which a cartridge is loaded in the apparatus.

In the printing apparatus 101 in FIG. 1, roll paper 1 (belt-like recording medium wound around a roller) and an ink ribbon 2 coated with ink are contained in a cartridge 102.

In a state before the cartridge 102 is loaded in the printing apparatus 101, the roll paper 1 is hermetically sealed by the cartridge 102 so as to prevent the user from directly touching the roll paper 1.

When the cartridge 102 is loaded in the printing apparatus 101, a roller 7 having the roll paper 1 wound therearound is connected to a rotation mechanism of a paper feed motor provided in the printing apparatus 101, whereby the rotation of the roller 7 is controlled by the printing apparatus 101.

Although in the present embodiment, the roll paper 1 and the ink ribbon 2 are enclosed together in the cartridge 102, two separate cartridges may be provided to contain roll paper and an ink ribbon, respectively.

Each of a feed roller 8 and a take-up roller 9 has the ink ribbon 2 wound therearound. When the cartridge 102 is loaded in the printing apparatus 101, the take-up roller 9 is connected to a rotation mechanism of an ink ribbon winding motor provided in the printing apparatus 101, whereby the rotation of the take-up roller 9 is controlled by the printing apparatus 101.

The roll paper 1 wound around the roller 7 is drawn out from the cartridge 102 via a cartridge outlet 102-1.

An uncurling roller 10 and an uncurling driven roller 11 correct curl of the roll paper 1. A grip roller 4-1 and a pinch roller 4-2 are disposed at respective locations opposed to each other via the roll paper 1, to nip the roll paper 1 from opposite sides.

As the grip roller 4-1 rotates clockwise, the roll paper 1 drawn out from the cartridge 102 is conveyed toward a thermal head 3. The thermal head 3 performs printing by sequentially transferring a plurality of color inks coated on an ink sheet to the roll paper 1 drawn out from the cartridge, in superimposed relation.

A platen roller 6 cooperates with the thermal head 3 to hold the ink ribbon 2 and the roll paper 1 in a superposed state. A discharge roller 12 conveys the roll paper 1 in a discharging direction (rightward as viewed in FIG. 1).

A sheet ejection roller 13 formed thereon with an uneven part ejects a printed portion cut off from the roll paper 1 into a discharge box, not shown. The discharge roller 12 and the sheet ejection roller 13 are disposed at respective locations opposed to each other via the roll paper 1, to nip the roll paper 1 from opposite sides.

A cutter unit 5 is comprised of a cutter blade and a support blade. The cutter blade and the support blade are disposed at respective locations opposed to each other via a conveying path of the roll paper 1. The cutter unit 5 is driven by a gear train, not shown, to scissor the roll paper 1 by sliding the upper and lower blades upon each other.

Next, an actual printing operation from the drawing-out of the roll paper 1 to the cutting and discharge of the same will be described following the procedure, with reference to FIGS. 2 to 6.

Figure 2:
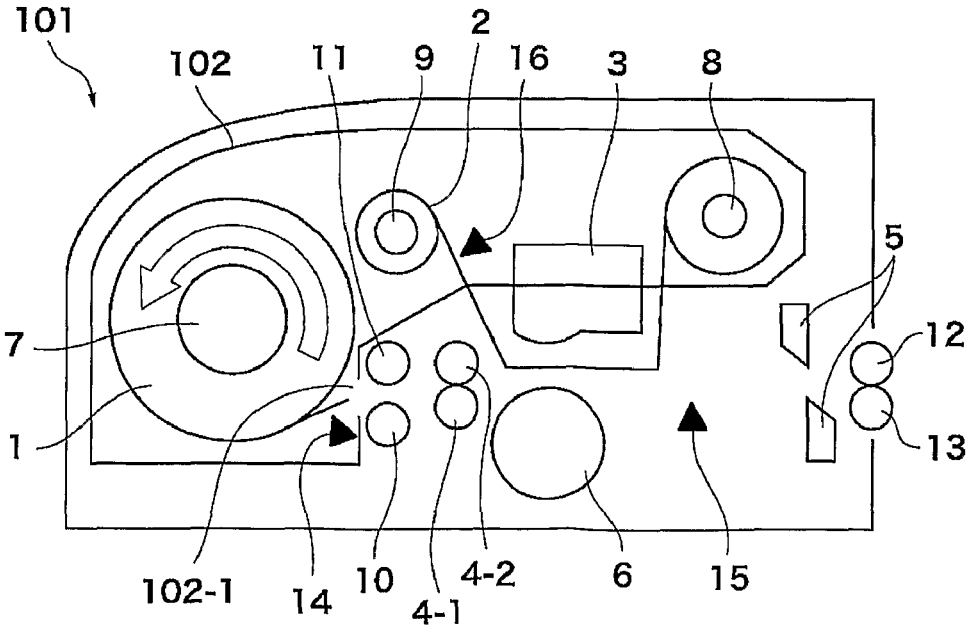
FIG. 2 is a view showing the printing apparatus according to the embodiment of the present invention in a state immediately after the start of an operation for feeding roll paper 1.
Figure 3:
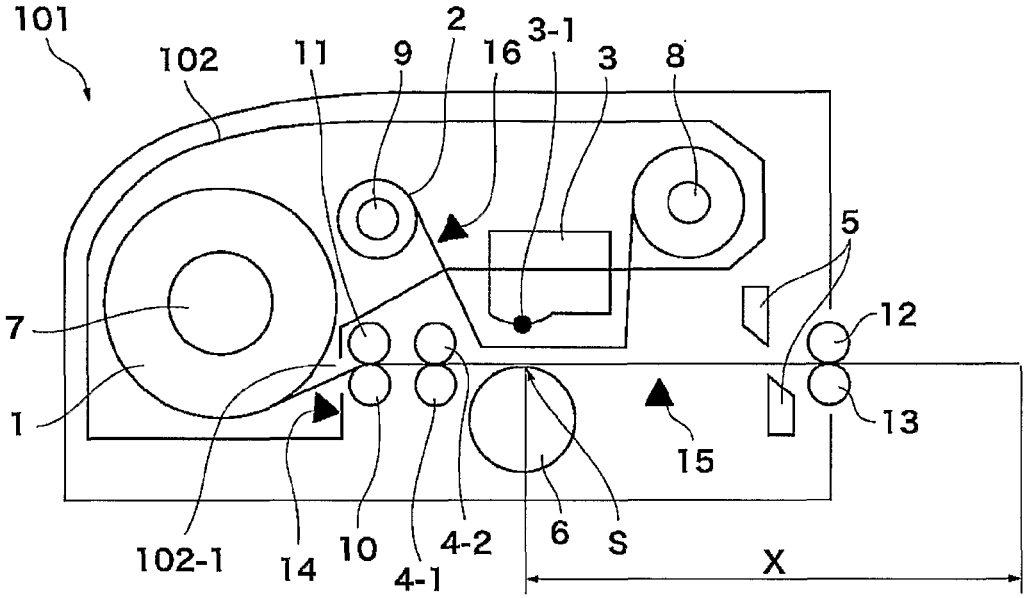
FIG. 3 is a view showing the printing apparatus according to the embodiment of the present invention in a state immediately before the start of a printing operation.

FIG. 2 is a view showing the printing apparatus according to the embodiment of the present invention in a state immediately after the start of an operation for feeding the roll paper 1. FIG. 3 is a view showing the printing apparatus according to the embodiment of the present invention in a state immediately before the start of a printing operation.

Figure 4:
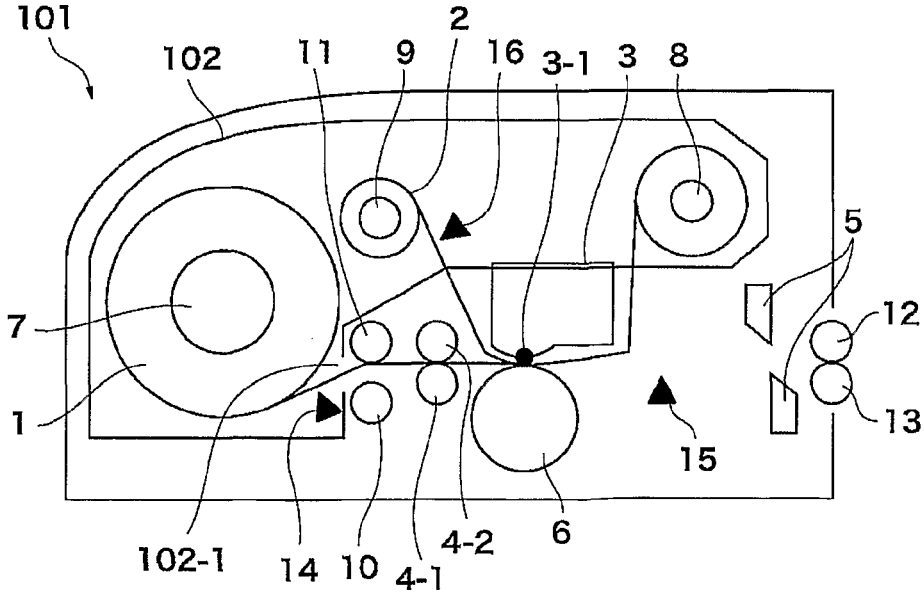
FIG. 4 is a view showing the printing apparatus according to the embodiment of the present invention in a state immediately after the end of the printing operation.
Figure 5:
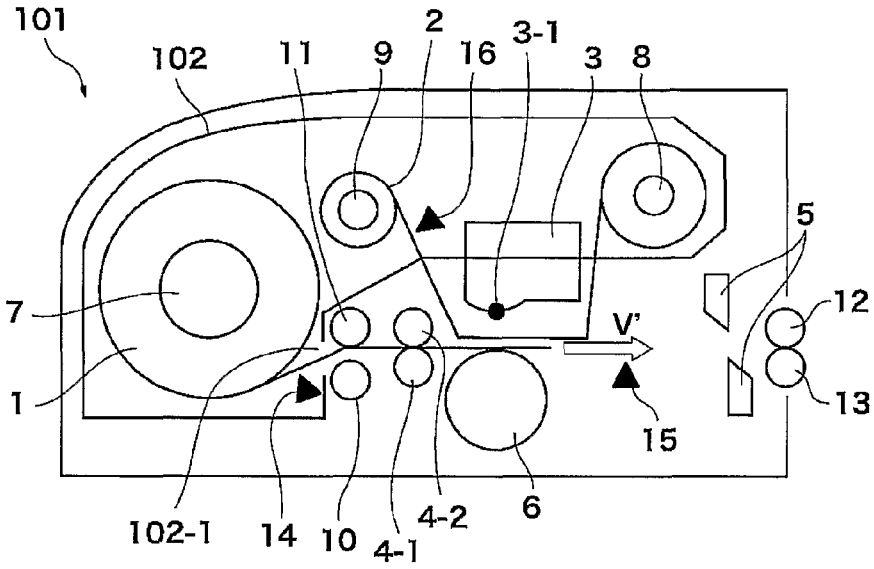
FIG. 5 is a view showing the printing apparatus according to the embodiment of the present invention in a state in which the roll paper is being returned after the start of a cooling time period.
Figure 6:
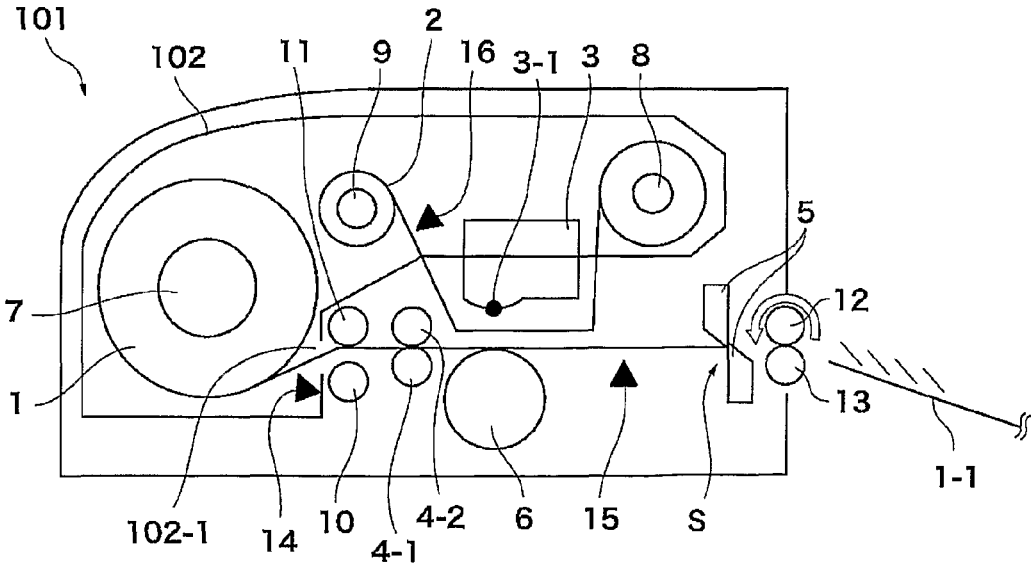
FIG. 6 is a view showing the printing apparatus according to the embodiment of the present invention in a state immediately after the end of a discharge operation.

Further, FIG. 4 is a view showing the printing apparatus according to the embodiment of the present invention in a state immediately after the end of the printing operation. FIG. 5 is a view showing the printing apparatus according to the embodiment of the present invention in a state in which the roll paper is being returned after the start of a cooling time period. FIG. 6 is a view showing the printing apparatus according to the embodiment of the present invention in a state immediately after the end of a discharge operation.

When the roller 7 for rotation in unison with the roll paper 1 is driven for rotation (counterclockwise) in the state shown in FIG. 2, the roll paper 1 starts rotation. In accordance with the rotation, the roll paper 1 wound around the roller 7 is progressively unwound, and as a consequence, the leading end of the roll paper 1 is drawn out from the cartridge 1 via the cartridge outlet 102-1.

A roll paper-detecting sensor 14 is disposed in the vicinity of the cartridge outlet 102-1 in a manner facing the roll paper 1 with a sufficient distance with respect to the width thereof.

This arrangement makes it possible to determine, based on a difference in detection timing of the roll paper-detecting sensor 14, how tilted the roll paper 1 is when the roll paper 1 is drawn out from the cartridge 1 via the cartridge outlet 102-1.

If an inclination detected here is larger than a tolerance, the drawing operation is stopped. If the roll paper 1 is drawn out in a skewed state, an inclination is increased during conveyance of the roll paper 1 within the printing apparatus 101. This not only hinders accurate printing, but in worst cases, it can also cause deviation of the roll paper 1 from a width range allowed for conveyance of the roll paper 1 in the printing apparatus 101.

The roll paper 1 drawn out from the cartridge 1 via the cartridge outlet 102-1 is guided to the uncurling roller 10, where an uncurling operation is carried out.

The uncurling roller 10 is formed of soft rubber. The uncurling roller 10 comes into pressure contact with the hard uncurling driven roller 11 disposed at a location opposed to the uncurling roller 10, and changes the advancing direction of the roll paper 1 to thereby change the shape of the same (i.e. uncurl the roll paper 1).

With this arrangement, the roll paper 1 is pressed in a direction opposite to a direction in which the roll paper 1 is wound around the roller 7, whereby curl given to the roll paper 1 by being held wound around the roller 7 is removed. It is to be understood that the arrangement for achieving uncurling of the roll paper 1 is not limited to the above-described example, but any other suitable arrangement may be employed.

For example, the roll paper 1 may be uncurled by being passed between wall-shaped hard members, or alternatively by being passed through a plurality of uncurling rollers in a zigzag fashion.

It should be noted that immediately after the roll paper 1 is drawn out, the uncurling roller 10 is in a withdrawn position (i.e. separated from the uncurling driven roller 11). Then, the uncurling roller 10 is brought into pressure contact with the uncurling driven roller 11 in timing in which the roll paper 1 is drawn out to a position facing the uncurling roller 10, whereby the roll paper 1 is nipped between the uncurling roller 10 and the uncurling driven roller 11.

The uncurled roll paper 1 is conveyed by the uncurling roller 10 to a conveying roller pair 4.

The conveying roller pair 4 is comprised of the grip roller 4-1 and the pinch roller 4-2. The grip roller 4-1 is in a position withdrawn from the pinch roller 4-2 until the roll paper 1 reaches the conveying roller pair 4. Then, the grip roller 4-1 is brought into pressure contact with the pinch roller 4-2 in timing in which the roll paper 1 is conveyed to a position facing the conveying roller pair 4, whereby the roll paper 1 is nipped by the conveying roller pair 4. The conveying roller pair 4 conveys the roll paper 1 while nipping the same until printing is completed and the roll paper is cut.

The grip roller 4-1 has a surface thereof formed with fine lugs projecting therefrom. The lugs bite into the reverse side of the roll paper 1 so that when the conveying roller pair 4 is rotated, the roll paper 1 can be reliably conveyed without slippage.

The roll paper 1 gripped by the grip roller 4-1 is further conveyed to be passed between the thermal head 3 and the platen roller 6 disposed at a location opposed to the thermal head 3.

After the platen roller 6 (i.e. at a location downstream of the platen roller 6 in the direction in which the roll paper 1 is conveyed), there is disposed a roll paper leading edge-locating sensor 15. When the leading edge of the roll paper 1 passing between the thermal head 3 and the platen roller 6 reaches a position immediately above the roll paper leading edge-locating sensor 15, the roll paper leading edge-locating sensor 15 is turned on.

Upon receipt of an ON signal from the roll paper leading edge-locating sensor 15, a controller installed on the printing apparatus 101 calculates a distance over which the roll paper 1 is to be conveyed, according to the size of a print image (image to be printed).

The roll paper 1 is conveyed by the grip roller 4-1 controlled based on a result of the calculation, and when the roll paper 1 reaches a preset print start position, the conveyance of the roll paper 1 is stopped. This completes the locating of the leading edge of a print area on the roll paper 1.

Assuming that the length of a print image in the sub-scanning-direction is equal to X, the print start position corresponds to a location where the printing start point S located at a distance, corresponding to the length X, from the leading edge of the roll paper 1 is immediately below a heating line 3-1 disposed on the substrate of the thermal head 3.

When the locating of the leading edge of the print area on the roll paper 1 is completed, the ink ribbon 2 contained in the cartridge 102 is wound up. The ink ribbon 2 is wound up by a ribbon winding motor provided in the printing apparatus 101 and a gear train (not shown) connected to the motor.

On the ink ribbon 2, there are repeatedly arranged a sequence of respective ink surfaces of yellow, magenta, cyan, and overcoat in order, and each color surface has a leading end to which an identification band of a color is applied along the width of the ink ribbon. It should be noted that the leading end of the ink surface of yellow as the first color has an identification band applied thereto which is different in color and shape from those of the other surfaces.

In the present embodiment, two identification bands are coated on the leading end of the ink surface of yellow as the first color so as to distinguish the same from the other color ink surfaces each having a single identification band coated on a leading end thereof. Each color is identified by a ribbon color leading edge-locating sensor 16, and an identification result is sent to the controller. This makes it possible to determine that the detected leading edge of an ink color surface is the first surface to be used for printing, i.e. the yellow ink surface.

When the ribbon color leading edge-locating sensor 16 recognizes the two identification bands coated on the ribbon surface, the ink ribbon winding motor is stopped. At the same time, a head up/down motor (not shown) for lifting and lowering the thermal head 3 is driven to bring the thermal head 3 into pressure contact with the platen roller 6.

When the thermal head 3 is moved to a predetermined position, the uncurling roller 10 is withdrawn to stop the uncurling operation. This prevents excess load from being applied onto the roll paper 1 during the printing operation.

Then, conveyance of the roll paper 1 is started by the grip roller 4-1, and at the same time the heating line 3-1 of the thermal head 3 is heated, whereby ink coated on the ink ribbon 2 is transferred onto the roll paper 1 to form an image.

At this time, since the roll paper 1 is conveyed in the reverse direction by the grip roller 4-1, the roll paper 1 is returned into the cartridge 102. Along with this return of the roll paper, the paper feed motor operates to cause rotation of the roller 7 in the reverse direction to the direction of rotation for pushing the roll paper 1 out at the start of the printing operation. Thus, the roll paper 1 is rewound without being sagged.

It should be noted that the paper feed motor has a clutch mechanism having slip torque. With this arrangement, the operation of the paper feed motor in the direction for drawing out the roll paper 1 transmits all force from the paper feed motor to the roll paper 1, whereas the operation of the paper feed motor in the direction for rewinding the roll paper 1 is performed with a predetermined amount of slip torque.

With the above-described arrangement, it is possible to rewind the roll paper 1 during the printing operation without applying excess stress to a portion of the roll paper 1 drawn out by the conveying roller pair 4.

The winding length of the ink ribbon 2, the rewinding length of the roll paper 1, and the distance of conveyance of the roll paper 1 by the conveying roller pair 4 for printing are controlled using timing of detection of each identification band coated on the ink ribbon 2, as a printing start reference.

For example, based on the printing start reference, printing is controlled to be performed by a length of approximately 150 mm when a postcard-size cartridge 102 is loaded, and is controlled to be performed by a length of approximately 127 mm when an L-size cartridge 102 is loaded. Thus, printing is performed within a range corresponding to the size.

Upon execution of printing by a predetermined length with respect to the printing start reference, the operation for winding the ink ribbon 2 and the operation for rewinding the roll paper 1 are stopped, and at the same time conveyance of the roll paper 1 by the grip roller 4-1 is also stopped (see FIG. 4).

When printing on the roll paper 1 in one color ink (yellow ink in the present example) is completed, the head up/down motor is driven to move the thermal head 3 to a predetermined withdrawn position. At the same time, the ink ribbon 2 is wound by a very small amount, whereby sag is removed from the ink ribbon 2.

Next, a return operation is carried out for conveying the roll paper 1 to the print start position in the opposite direction to the conveying direction for printing. Conveyance at this time is performed only by an amount corresponding to the conveyance distance for printing.

If a temperature detected by a thermistor (not shown) disposed in the vicinity of the thermal head 3, after completion of the printing operation, has exceeded a reference temperature (60° C. in the present embodiment), the return operation is carried out at a roll paper conveying speed reduced to a velocity V' 1/20 of a normal velocity V.

The normal velocity V (first conveying speed) is a preset conveying speed, and the velocity V' (second conveying speed) is a conveying speed which is slower than the velocity V'.

Then, when the temperature detected by the thermistor becomes lower than 60° C. the roll paper conveying speed is switched to the normal velocity V, and the return operation is completed (see FIG. 5).

If the roll paper 1 has reached the print start position before the temperature detected by the thermistor becomes lower than 60° C., the roll paper 1 is conveyed again toward the printing end position without stopping at the print start position with the roll paper conveying speed held at the second conveying speed.

Then, the roll paper 1 is reciprocated between the print start position and the printing end position until the temperature detected by the thermistor becomes lower than 60° C. When the temperature becomes lower than 60° C., the roll paper conveying speed is switched to the normal velocity V, and the roll paper 1 is conveyed to the print start position, and the return operation is completed. That is, until the head temperature becomes lower than 60° C., the conveying is continued in a reciprocating manner without stopping the conveying operation.

The above-described cooling operation prevents the head temperature of the thermal head 3 and the temperature within the printing apparatus from rising to damage component parts or to affect a printing process to hinder execution of normal printing. Although in the present embodiment, the cooling operation is performed according to the head temperature, it may be performed by detecting the temperature within the printing apparatus using a thermistor provided within the apparatus and in response to a rise in the temperature within the apparatus.

When the return operation is completed and the roll paper 1 reaches the print start position, the same printing operation is started for magenta ink. After completion of the printing operation for magenta ink, the same printing process is carried out for cyan ink, and then for overcoat. In short, yellow ink, magenta ink, cyan ink, and overcoat ink are sequentially transferred to generate an image.

Also, after completion of printing in magenta ink or cyan ink, a temperature detected by the thermistor is checked, and when the temperature has exceeded 60° C., a return operation is started at the velocity V'. Then, when the temperature becomes lower than 60° C., the roll paper conveying speed is switched to the normal velocity V, and the return operation is terminated.

When overcoat processing is completed, the roll paper 1 is conveyed by the operation of the grip roller 4-1 until the printing start point S on the roll paper 1 reaches a cutting position of the cutter unit 5. When the printing start point S on the roll paper 1 reaches the cutting position, the rotation of the grip roller 4-1 is stopped, and the discharge roller 12 is rotated in the discharging direction.

The above-mentioned operation makes it possible to stretch the roll paper 1 without sag, between the grip roller 4-1 and the discharge roller 12, to thereby reliably bring the printing start point S on the roll paper 1 to the cutting position.

When a cutter motor of the cutter unit 5 is driven after the printing start point S is aligned on the cutting position, the roll paper 1 is cut at the printing start point S.

Although in the present embodiment, the method of scissoring the roll paper 1 transversely by sliding the upper and lower blades upon each other is described as a cutting method using the cutter blade, this is not limitative. For example, there may be employed a cutting method of cutting the roll paper 1 by moving a rotating circular rotary blade or alternatively by moving a cutter blade perpendicularly in a vertical direction.

A printout 1-1 produced by cutting the roll paper 1 by the cutting processing is held in a state gripped by the discharge roller 12. The discharge roller 12 is driven in this state to convey the printout 1-1 in the discharging direction.

The sheet ejection roller 13 is disposed at a location opposed to the discharge roller 12. When the printout 1-1 is conveyed in the discharging direction, the end of the printout 1-1 is brought into engagement with the uneven part of the sheet ejection roller 13. As a result, the printout 1-1 is ejected into a discharge box (not shown) (see FIG. 6).

At this time, an auxiliary ejection lever disposed coaxially with the rotating shaft of the discharge roller 12 urges the print surface of the printout 1-1 toward the discharge box, which makes it possible to more reliably bring the printout 1-1 into the discharge box. The discharge roller 12 stops its rotation after being driven over a predetermined time period.

Thus, the printing operation is completed.

In the case of printing the next image in succession, assuming that the sub-scanning-direction length of the next image measured from the leading edge of a new part of the roll paper after the cutting is equal to a length X', conveyance of the roll paper 1 is controlled as follows:

The roll paper 1 is conveyed until a printing start point S' located at a distance corresponding to the length X' from the roll paper leading edge reaches the position (next-image print start position) immediately below the heating line 3-1 disposed on the substrate of the thermal head 3, whereby the operation of locating a roll paper print start position is completed, and then the above-described printing operation is carried out again.

As is apparent from the above description, according to the present embodiment, when cooling time is started, a return operation is performed with the roll paper conveying speed held slower than the normal conveying speed.

As a consequence, the constant rotation of the grip roller 4-1 is maintained even during the cooling time, so that it is possible to avoid formation of a linear recess in the roll paper 1 which occurs when the roll paper 1 has been nipped at the same position over a predetermined time period or longer.

Further, since hindrance of proper ink transfer by formation of a linear recess in a print area for an image or a next image can be prevented, it is possible to obviate the necessity of providing a marginal area before the next-image print area and cutting away the marginal area, to thereby prevent waste of the roll paper.

Although in the above-described embodiment, switching of the roll paper conveying speed from the velocity V' as the second conveying speed to the normal conveying speed during a return operation is performed when temperature detected by the thermistor becomes lower than 60° C., a method in which a time period over which conveyance is to be performed at the second conveying speed is preset can also be employed. The other features of the configuration and control method of this variation are the same as those in the above-described embodiment except for the above-mentioned point.

Figure 7:
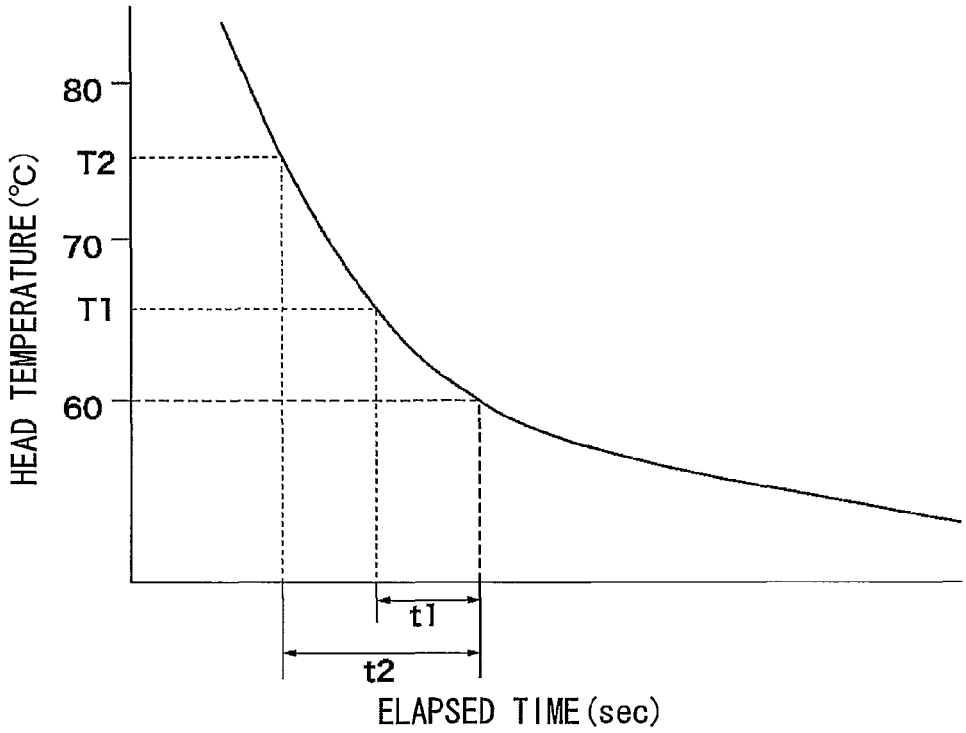
FIG. 7 is a graph showing temporal changes in the temperature of a thermal head appearing in FIG. 1, during the cooling time period.

Head temperature change that occurs when the thermal head 3 is cooled from a predetermined temperature can be represented by an exponential function curve as shown in FIG. 7 insofar as the same cooling system is used.

Accordingly, if the head temperature is T1, a time period required to lower the head temperature to 60° C. is determined as t1, and a time period required to lower the head temperature from T2 to 60° C. is determined as t2.

Figure 8:
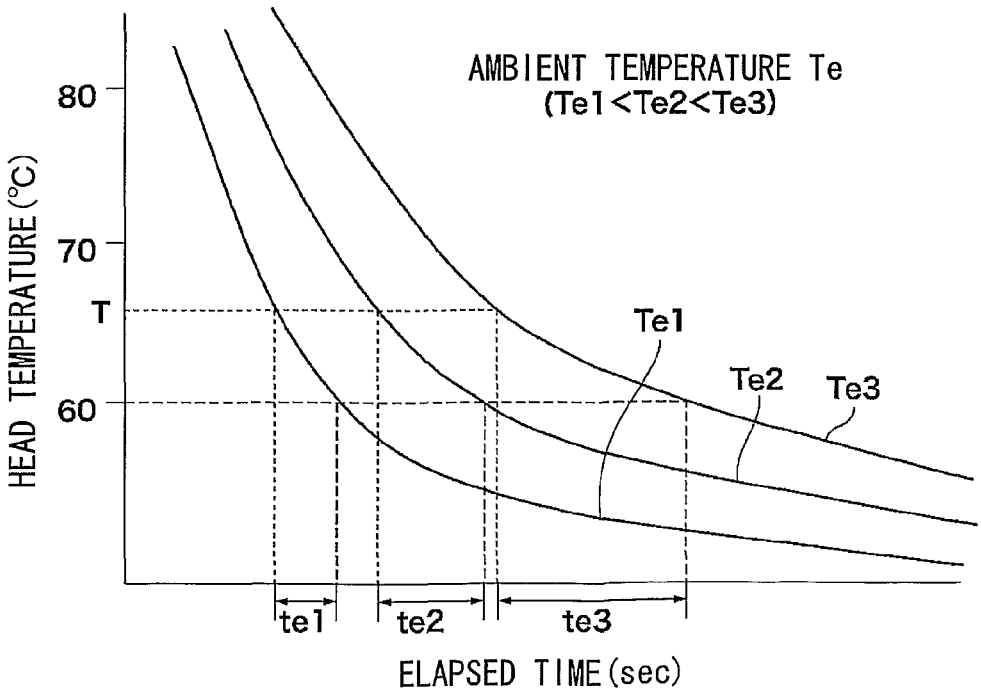
FIG. 8 is a graph showing temporal changes in the temperature of the thermal head appearing in FIG. 1, during the cooling time period under different ambient temperatures.

However, this calculation requires as a precondition that the ambient temperature around the thermal head 3 is the same. When the ambient temperature around the thermal head 3 is different, the head temperature change can be represented by different temperature change curves associated with respective ambient temperatures e.g. as shown in FIG. 8.

For example, when the temperature of the thermal head 3 is T, time periods taken to lower the head temperature to 60° C. in the respective ambient temperatures Te1, Te2, and Te3 (Te1<Te2<Te3) are determined as te1, te2, and te3, respectively.

In view of these characteristics, time periods taken to lower the head temperature to 60° C. are stored as a database in association with respective head temperatures and respective ambient temperatures in the controller, described hereinafter, for drivingly controlling the printer. Alternatively, formulas of temperature change curves associated with the thermal head 3 in the respective ambient temperatures are stored in the controller.

Then, when a temperature of the thermal head 3 and an ambient temperature within the apparatus after completion of printing in each color are detected by the thermistor or the like, the database is referred to or the associated formula is used for calculation, to thereby estimate a cooling time period required to lower the head temperature to 60° C. Thus, an optimal roll paper conveying time period for conveyance at the second conveying speed, corresponding to a roll paper return-conveying distance, can be calculated.

Figure 9:
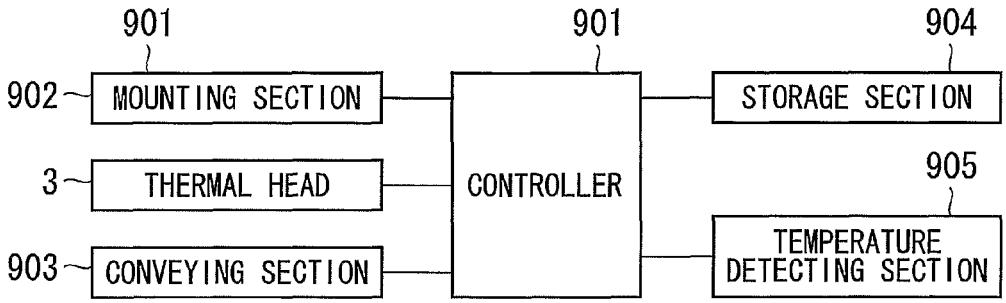
FIG. 9 is a control block diagram of essential parts of the printing apparatus according to the embodiment of the present invention.
Figure 10:
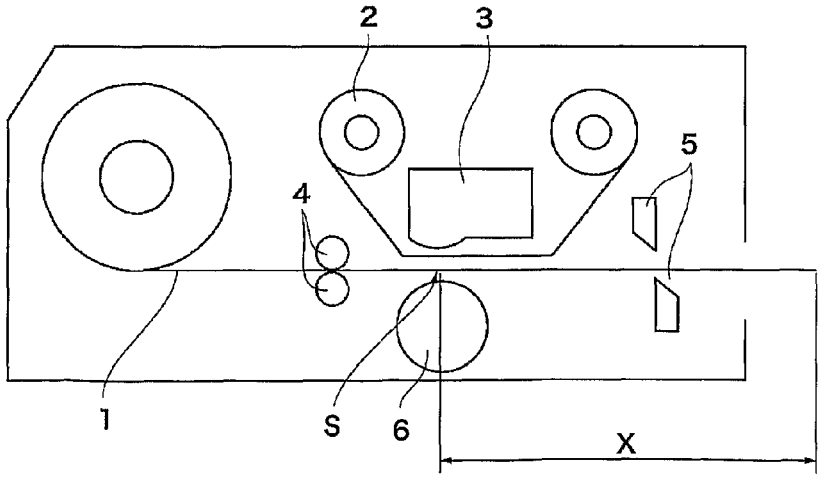
FIG. 10 is a view showing a conventional printing apparatus using roll paper in a state immediately before the start of a printing operation.
Figure 11:
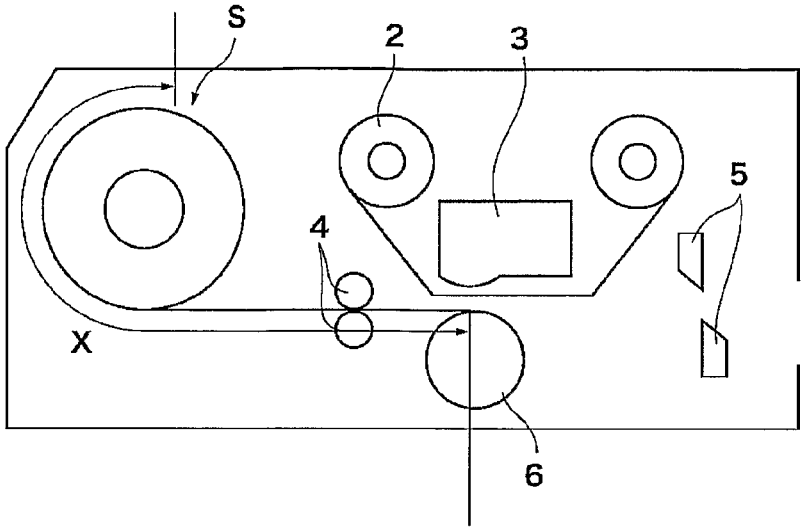
FIG. 11 is a view showing the conventional printing apparatus in a state immediately after the end of the printing operation
Figure 12:
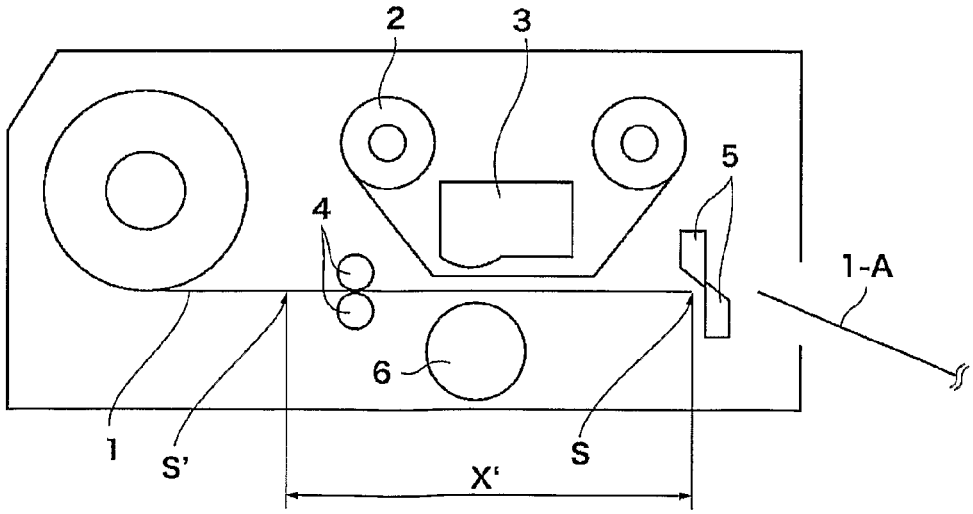
FIG. 12 is a view showing the printing apparatus in a state immediately after the end of a discharge operation.

FIG. 9 is a control block diagram of essential parts of the printing apparatus according to the present embodiment of the present invention.

Referring to FIG. 9, a controller 901 is connected to units (sections) described below, and the units are controlled by the controller 901.

A mounting section 902 receives the cartridge 102 containing the roll paper 1. The thermal head 3 transfers ink from the ink ribbon 2 onto the roll paper 1. A conveying section 903 conveys the roll paper 1.

A storage section 904 stores the normal conveying speed V set for printing performed while rewinding the roll paper 1 and the conveying speed V' set to be slower than the normal conveying speed. A temperature detecting section (e.g. a thermistor) 905 detects the temperature within the apparatus while the thermal head 3 is in operation.

During a return operation for feeding and conveying the roll paper 1 to the print start position for a next printing operation, the controller 901 normally conveys the roll paper at the conveying speed V. However, when temperature detected by the temperature detecting section 905 after completion of printing in one color ink is higher than a predetermined value, the controller 901 switches the conveying speed for conveyance the roll paper by the conveying roller pair 4 to the conveying speed V'. Further, after the temperature has become lower than the predetermined value, the controller 901 switches the roll paper conveying speed to the normal conveying speed V. The cooling operation is thus performed while conveying the roll paper, which prevents the roll paper from being at rest in a state nipped by the conveying roller pair 4. Therefore, it is possible to avoid formation of a recess in the roll paper 1 which occurs when the roll paper 1 is nipped at the same position over a certain time period.

During the return operation for feeding and conveying the roll paper 1 to the print start position for a next printing operation, the controller 901 can also perform control such that when temperature detected by the temperature detecting section 905 has exceeded a predetermined value, the roll paper conveying speed is switched to the conveying speed V' and the conveying speed V' is held for a time period calculated according to the detected temperature. In this case, the roll paper conveying speed is switched to the normal conveying speed V after the lapse of the time period determined by the calculation or after the detected temperature has become lower than the predetermined value.

Further, the conveying speed for a return operation may be calculated after calculation of a time period required for a cooling operation according to the detected temperature, such that the roll paper 1 can be brought to the print start position by conveyance over the calculated time period. In this case, a suitable conveying speed Vc is calculated from a time period required for cooling, which is calculated based on a head temperature and an ambient temperature, and a conveying distance to the print start position. The conveying speed Vc may be determined by calculation in the printing apparatus, or alternatively by referring to a table storing Vc values in association with respective detected head temperatures and ambient temperatures.

By thus determining the conveying speed for a return operation according to the detected head temperature, it is possible to bring the roll paper to the print start position after completion of the cooling operation, so that a printing operation using a next ink can be started immediately after the cooling operation.

INDUSTRIAL APPLICABILITY

The present invention is applied to a printing apparatus, and more particularly to a printing apparatus using roll paper. According to the present invention, even when the operation of the printing apparatus is stopped for cooling, it is possible to perform excellent printing without leaving a conveying roller mark on roll paper for printing of a next image.

This applications claims the benefit of Japanese patent application number 2008-067879 filed Mar. 17, 2008 and Japanese patent application number PCT/JP2009/055560 filed Mar. 16, 2009, all of which are incorporated by reference herein in their entireties.

What is claimed is:

1. A printing apparatus comprising:

a thermal head configured to perform printing by sequentially transferring a plurality of color inks held on an ink sheet onto recording paper in superimposed relation;

a conveying unit configured to convey the recording paper in a nipped state so as to transfer the color inks onto the recording paper;

a detecting unit configured to detect a temperature within the printing apparatus; and a control unit configured to be operable after completion of printing in one color, to cause said conveying unit to convey the recording paper to a print start position at a first conveying speed in an opposite direction to a direction in which the recording paper is conveyed for printing, so as to carry out printing in a next color, wherein when the temperature detected by said detecting unit is higher than a predetermined value, said control unit causes said conveying unit to convey the recording paper to the print start position at a second conveying speed which is slower than the first conveying speed.

2. The printing apparatus according to claim 1, wherein the recording paper is roll paper.

3. The printing apparatus according to claim 1, wherein said control unit causes said conveying unit to convey the roll paper at the second conveying speed for a time period corresponding to the temperature detected by said detecting unit.

4. The printing apparatus according to claim 1, wherein when a temperature lower than the predetermined value is detected by said detecting unit during conveyance of the roll paper at the second conveying speed, said control unit switches the second conveying speed to the first conveying speed and causes said conveying unit to convey the roll paper to the print start position.

5. The printing apparatus according to claim 1, wherein the first conveying speed is a preset velocity, and the second conveying speed is a velocity determined according to the temperature detected by said detecting unit.

6. The printing apparatus according to claim 1, wherein said detecting unit detects a temperature in the vicinity of the thermal head.

7. A method of controlling a printing apparatus which performs printing by sequentially transferring a plurality of color inks coated on an ink sheet onto roll paper in superimposed relation by a thermal head while conveying the roll paper in a state nipped by a conveying unit, comprising:

detecting a temperature within the apparatus; and after completion of printing in one color, causing the conveying unit to convey the roll paper to a print start position at a first conveying speed in an opposite direction to a direction in which the roll paper is conveyed for the printing operation, so as to carry out printing in a next color, wherein when the detected temperature is higher than a predetermined value, the roll paper is conveyed to the print start position at a second conveying speed which is slower than the first conveying speed.

8. A printing apparatus comprising:

a thermal head configured to perform printing by sequentially transferring a plurality of color inks held on an ink sheet onto recording paper in superimposed relation;

a conveying unit configured to convey the recording paper in a nipped state so as to transfer the color inks onto the recording paper;

a detecting unit configured to detect a temperature within the printing apparatus; and a control unit configured to be operable after completion of printing in one color, to cause said conveying unit to convey the recording paper to a print start position at a first conveying speed in an opposite direction to a direction in which the recording paper is conveyed for printing, so as to carry out printing in a next color, wherein when the temperature detected by said detecting unit is higher than a predetermined value, said control unit does not stop causing said conveying unit to convey the recording paper even after the recording paper is conveyed to the print start position.

9. The printing apparatus according to claim 1, wherein the recording paper is roll paper.

10. The printing apparatus according to claim 8, wherein said control unit repeats conveyance of the recording paper in the direction for printing and in the opposite direction thereto, without stopping the conveyance of the recording paper.

11. The printing apparatus according to claim 1, wherein said control unit continues conveyance of the recording paper until the temperature detected by said detecting unit becomes not higher than the predetermined value.

12. A method of controlling a printing apparatus which performs printing by sequentially transferring a plurality of color inks coated on an ink sheet onto roll paper in superimposed relation by a thermal head while conveying the roll paper in a state nipped by a conveying unit, comprising:

detecting a temperature within the apparatus; and after completion of printing in one color, causing the conveying unit to convey the roll paper to a print start position at a first conveying speed in an opposite direction to a direction in which the roll paper is conveyed for the printing operation, so as to carry out printing in a next color, wherein when the temperature detected by said detecting unit is higher than a predetermined value, said control unit does not stop causing said conveying unit to convey the recording paper even after the recording paper is conveyed to the print start position.

* * * * *